US006634411B2

(12) United States Patent
Hirano et al.

(10) Patent No.: US 6,634,411 B2
(45) Date of Patent: Oct. 21, 2003

(54) GAS DISCHARGE SYSTEMS FOR DIE-CASTING MACHINES AND METHODS FOR DISCHARGING GASES

(75) Inventors: Masakazu Hirano, Kariya (JP); Koichi Kawaura, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/207,930

(22) Filed: Jul. 29, 2002

(65) Prior Publication Data

US 2003/0019605 A1 Jan. 30, 2003

(30) Foreign Application Priority Data

Jul. 30, 2001 (JP) ..... 2001-230170

(51) Int. Cl.[7] ..... B22C 3/00; B22D 17/00

(52) U.S. Cl. ..... 164/72; 164/113; 164/305; 164/312

(58) Field of Search ..... 164/72, 14, 74, 164/267, 305, 410, 113, 312

(56) References Cited

U.S. PATENT DOCUMENTS 3,631,791 A * 1/1972 Harris et al. ..... 454/49
6,192,968 B1 * 2/2001 Renkl et al. ..... 164/121
6,461,669 B1 * 10/2002 Hanano et al. ..... 427/135

FOREIGN PATENT DOCUMENTS

JP 06-126416 5/1994

* cited by examiner

*Primary Examiner*—Kuang Y. Lin
(74) *Attorney, Agent, or Firm*—Morgan & Finnegan, LLP

(57) ABSTRACT

A discharge system (100) may discharge gases produced by a die-casting machine. The die-cast machine may include a first die (150) and a second die (170) that are configured in order to form cast products. A closure device defines an enclosed region (190) between opposing surfaces (151, 171) of the first and second dies. A transfer device (110, 120, 122, 130) serves to discharge the gases within the enclosed region to the outside. The first and second dies are configured to form a portion of the closure device.

13 Claims, 2 Drawing Sheets

GAS DISCHARGE SYSTEMS FOR DIE-CASTING MACHINES AND METHODS FOR DISCHARGING GASES

BACKGROUND OF THE INVENTION

1. Technical Field

The present invention relates to discharge systems for discharging gases produced in die-casting machines to the outside of the die-cast machines. The present invention also relates to methods for discharging gases from the die-cast machines.

2. Description of the Related Art

In general, die-cast machines are equipped with spray devices that serve to spray mold-releasing agents onto a mold after a cast product has been removed from the mold. The die-casting machines also are equipped with discharge systems that serve to discharge the mold-releasing agents that have been gasified after sprayed onto the mold. Japanese Laid-Open Patent Publication No. 6-126416 teaches a known discharge system for discharging a gasified mold-releasing agent as an exhaust gas. The known discharge system includes a hood for covering the upper portion of a mold and also includes a discharge duct that is connected to the hood. A blower is mounted on the discharge duct and is operated to draw the gasified mold-releasing agent upward with respect to the mold.

However, in the known discharge system, the hood covers only the upper side of the mold. Therefore, even if the suction force produced by the blower is increased, only a limited portion of the gasified mold-releasing agent can be prevented from dispersing to the outside of the mold. Therefore, a portion of the gasified mold-releasing agent may be dispersed to the outside, thereby disadvantageously affecting the working environment.

SUMMARY OF THE INVENTION

Therefore, it is one object of the present teachings to provide improved techniques for reliably discharging gases that may be produced in die-casting machines.

In one of the aspect of the present teachings, discharge systems may discharge gases produced in die-casting machines. The die-casting machines may include a first die and a second die arranged and constructed to form cast products. A cavity may be defined between the first die and the second die. Molten material may be injected into the cavity, so that products may be cast to have a configuration that conforms to the configuration of the cavity.

Preferably, the discharge systems may include a closure device and a transfer device. The closure device may define a substantially enclosed region between opposing surfaces of the first and second dies.

In another aspect of the present teachings, the fist and second dies may define a part of the enclosed region when they are opend. In other words, the first and second dies may serve as a part of the discharge system. The remaining portions of the closure device may be defined by shield plates or air curtains that may be formed by streams of air. In this specification, the term "substantially enclosed region" is intended to include a region that is completely sealed to inhibit the flow of fluid to and from the region, or a region that is not completely sealed from the outside, but is surrounded and shielded by the closure device such that fluid in the region may be substantially prevented from dispersing to the outside of the region or entering the region.

In another aspect of the present teachings, a transfer device may transfer the gases within the enclosed region to the outside. Preferably, the transfer device may include a blower for charging or forcing air into the enclosed region, a suction blower for drawing the gases from the enclosed region, or a combination of these blowers.

Therefore, gases produced within the die-casting machines may be confined within the enclosed region, so that unfavorable dispersion of the gases to the outside of the enclosed region may be minimized. The gases within the enclosed region may be discharged to the outside by means of the transfer device. As a result, the working environment surrounding the die-casting machines can be maintained in a favorable condition.

Thus, the dispersion of the gases to the outside of the enclosed region may be reliably prevented and the gases may be reliably discharged to the outside. In particular, these discharge systems may be rationally configured, because the first and second dies of the die-cast machines can be utilized as a part of the closure device.

In this specification, the term "gases" may broadly include vapors, mists or mixtures of vapor and mist. For example, gases that may be produced in die-casting machines may include mold-releasing agents that have been gasified after application to the mold. The mold-releasing agents are generally used to ensure the removal of the cast products from the mold. Furthermore, the gases may include cooling water that has been sprayed onto the mold and vaporized after cooling the mold.

According to another aspect of the present teachings, methods for discharging gases produced in die-casting machines are taught. The methods may optionally include a step of defining a substantially enclosed region between opposing surfaces of the first and second dies by the first and second dies. Further, the methods may include discharging gases within the enclosed region to the outside.

Additional objects, features and advantages of the present invention will be readily understood after reading the following detailed description together with the accompanying drawings and the claims.

DETAILED DESCRIPTION OF THE INVENTION

Figure 1:
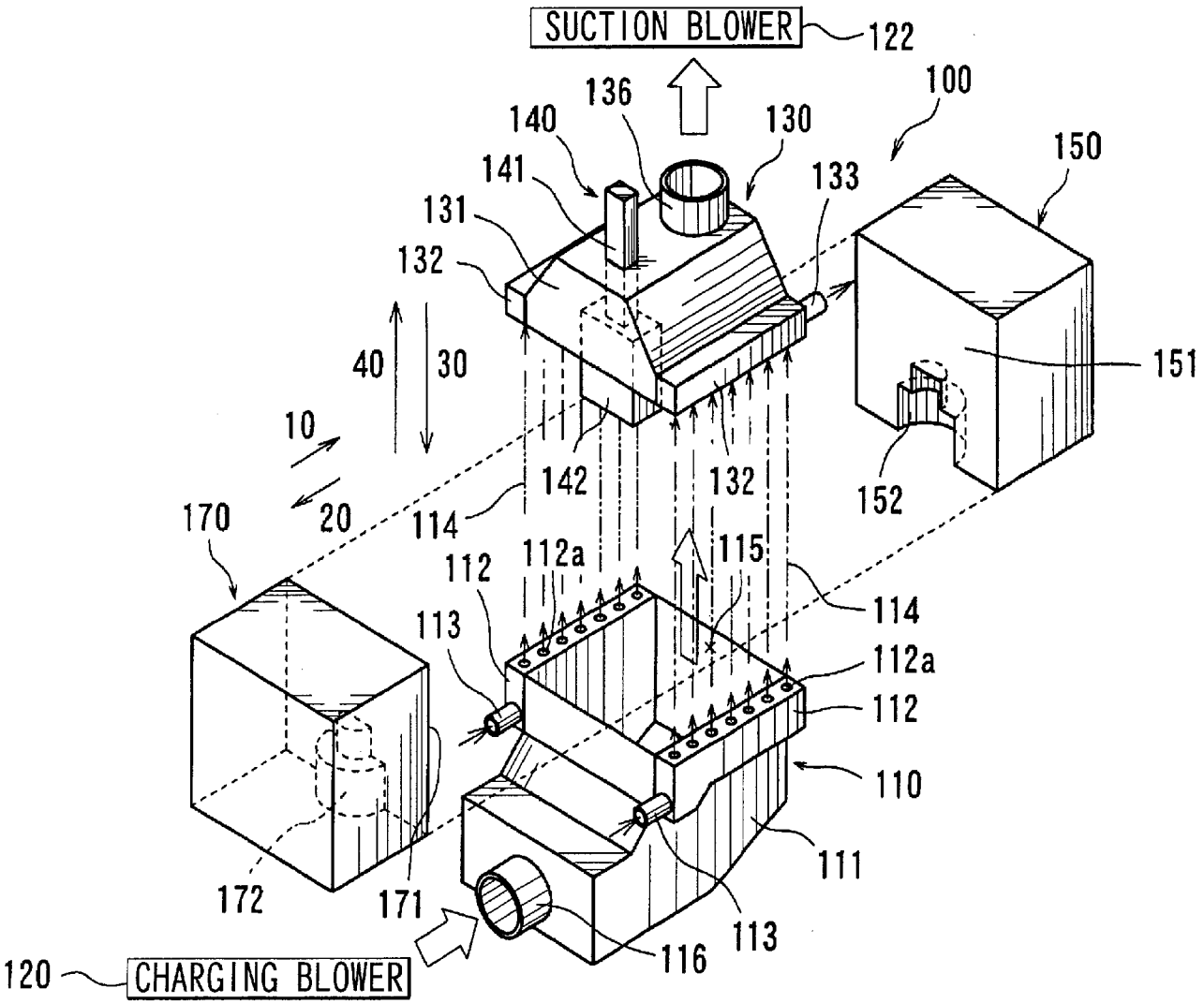
FIG. 1 is an exploded perspective view of a representative discharge system.

In one embodiment of the present teachings, discharge systems may include a closure device that may define a substantially enclosed region, in which gases may be confined. Such gases may include gasified mold-releasing agents, water vapor or any other gases. The gases confined within the enclosed region may be discharged to the outside by a transfer device.

In another embodiment of the present teachings, the closure device may include an air supply device in addition to the fist and second dies. Preferably, the air supply device may form an air curtain that defines a part of the enclosed region. Such an air curtain may be easily created and stopped by controlling the supply of air to the air supply device In another embodiment of the present teachings, the transfer device may include at least one of a charging blower and a suction blower. Thus, the transfer device may include one of the charging blower and the suction blower or both of the charging blower and the suction blower. Preferably, the charging blower may be disposed on the upstream side of the enclosed region. The charging blower may blow air toward the enclosed region in order to produce a stream of air that may suction the gases within the enclosed region and discharge the gases to the outside of the enclosed region. The suction blower may be disposed on the downstream side of the enclosed region. The suction blower may draw the gases within the enclosed region in order to produce a stream of air so as to discharge the gasses to the outside. Therefore, gases within the enclosed region may be reliably discharged to the outside.

In another embodiment of the present teachings, the enclosed region may have six sides that has a first set of opposing sides, a second set of opposing sides and a third set of opposing sides. The first set of opposing sides may be defined by the first and second dies. Preferably, the closure device may include first and second air supply devices that may form air curtains, which air curtains may provide shields at the second set of opposing sides of the enclosed region. The transfer device may includes a pair of opposing first and second ducts that may defined the third sets of opposing sides of the enclosed region. The charging blower or the suction blower may be connected, to one of the first and second ducts, so that an air flow path passing through the enclosed region may be provided by the first and second ducts.

In another embodiment of the present teachings, the first and second air supply devices may be disposed on the first duct. First and second air collecting devices may be disposed on the second duct and may respectively collect the air supplied from the first and second air supply devices.

In another embodiment of the present teachings, the first and second dies may move toward and away from each other so as to open and close the dies. The first and second ducts also may move toward and away from each other. Therefore, the first and second ducts may be positioned not to interfere with the closed dies.

In another embodiment of the present teachings, the discharge systems may be designed to discharge gases of mold-releasing agents that are sprayed onto the first and second dies. The mold-releasing agents may be applied to the dies in order to enable cast products to be easily removed from the dies. Preferably, the mold-releasing agents may be applied to the dies via a spray device. The mold-releasing agents sprayed onto the dies may be partially gasified by the heat of the dies. Because the mold-releasing agents may be frequently applied, e.g., every time that the mold is opened, the gasified mold-releasing agents may deteriorate the working environment if they are dispersed to the surrounding environment. The discharge systems may prevent the gasified mold-releasing agents from dispersing to the surrounding environment and may reliably discharge excess mold-releasing agents to the outside.

In another embodiment of the present teachings, methods for discharging gases produced in die-casting machines may optionally include the step of defining a substantially enclosed region between opposing surfaces of the first and second dies by the first and second dies. Further, gases within the enclosed region may be discharged to the outside.

In addition, the present methods may further include the step of producing flow of air to define a part of the enclosed region other than the part defined by the first and second dies. The flow of the air may produce an air curtain that can be easily created and stopped by controlling the supply of the air.

Further, the present methods may also include the step of transferring the gases within the enclosed region by at least one of a charging operation of air into the enclosed region and a drawing operation of air from the enclosed region. Therefore, the gasses may be reliably discharged to the outside.

Each of the additional features and teachings disclosed above and below may be utilized separately or in conjunction with other features and teachings to provide improved gas discharge systems for die-casting machines and methods for designing and using such gas discharge systems. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A representative discharge system 100 will now be described with reference to FIGS. 1 and 2. The representative discharge system 100 may be designed to discharge gasified mold-releasing agents to the outside. The mold-releasing agents may be sprayed on surfaces of the dies of a mold within a die-cast machine. The mold may include a fixed die 150 and a movable die 170. The representative discharge system 100 is shown in FIG. 1 and may include various parts that are shown in exploded views for an illustration purpose.

Figure 2:
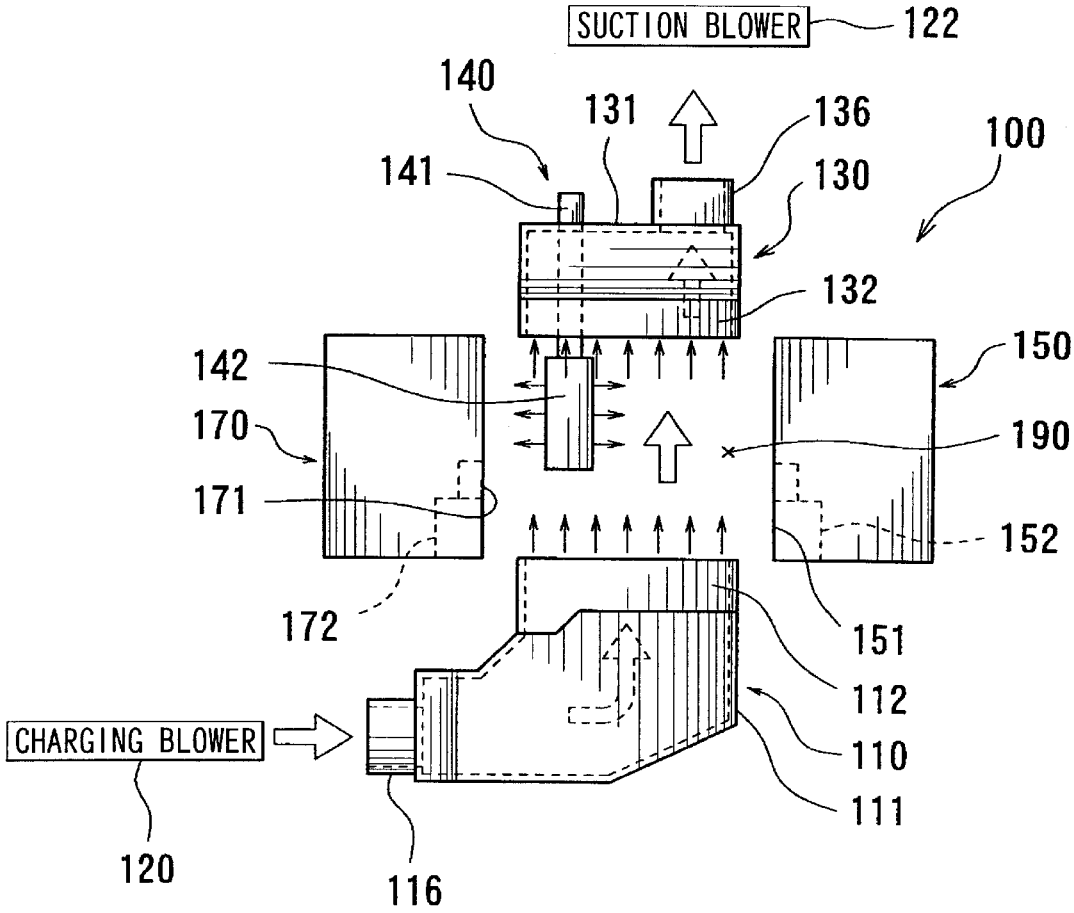
FIG. 2 is a schematic view of the representative discharged device during a discharge operation.

Referring to FIG. 1, the discharge system 100 may include a fixed duct 110, a movable duct 130, a charging blower 120 mounted to an upstream side (left side as viewed in FIG. 1) of the fixed duct 110, and a suction blower 122 mounted to a downstream side (upper side as viewed in FIG. 1) of the movable duct 130. The fixed die 150 and the movable die 170 may have opposing surfaces 151 and 172 that contact to each other when the mold including the dies 150 and 170 are closed. Spaces 152 and 172 may be defined within the respective opposing surfaces 151 and 172. Further, the spaces 152 and 172 may cooperate to form a cavity, and molten materials may be charged into the cavity after the dies 150 and 170 are closed. The movable die 170 may move relative to the fixed die 150 in both directions, as indicated by arrows 10 and 20.

The fixed duct 110 may include an inlet port 116 disposed on the upstream side of a duct body 111. The charging blower 120 may supply air to a chamber 115 via the inlet port 116. A pair of air supply devices 112 may be disposed on the fixed duct 110. Each of the supply devices 112 may be formed with a plurality of supply holes 112*a*. Pressurized air may be supplied to each of the supply devices 112 via a supply pipe 113, so that the air may be blown upward from the corresponding supply holes 112*a*. The streams of the blown air may form air jet regions or air curtains 114 on both sides of the fixed duct 110, as indicated by chain lines in FIG. 1.

The movable duct 130 may include an outlet port 136 disposed on the downstream side of the duct body 131, so that the gasified mold-releasing agents may be drawn or suctioned by the suction blower 122 and may then be discharged through the outlet port 136. Preferably, the movable duct 130 may move relative to the fixed duct 110 in directions as indicated by arrows 30 and 40. A pair of air collecting devices 132 may be mounted on the movable duct 130 in positions opposing the air supply devices 112. Therefore, the air supplied from the air supply devices 112 that forms the air curtains 114 may be collected by the air collecting devices 132 and may thereafter be discharged through corresponding discharge pipes 133 that are mounted on the movable duct 130.

A spray device 140 may be mounted on the movable duct 130 and may include a sprayer 142 that is connected to a lower end of a supply pipe 141. The mold-releasing agents may be supplied to the sprayer 142 via the supply pipe 141 and may be sprayed toward the opposing surfaces 151 and 171 of the movable die 170 and the fixed die 100. Preferably, the sprayer 142 may include a plurality of air spray nozzles oriented toward the dies 170 and 150.

A representative method for discharging the gaseous mold-releasing agents by using the above representative discharge system 100 will now be described with reference to FIG. 2, which schematically illustrates the arrangement of the discharge system 100 during the discharge operation.

The discharge system 100 may be operated during a step of spraying the mold-releasing agents, which step may be performed after the cast product has been taken out of the mold. In order to operate the discharge system 100, the movable die 170 and the movable duct 130 may be moved relative to the fixed die 150 and the fixed duct 110, respectively, so as to be positioned as shown in FIG. 2. In this state, the opposing surfaces 151 and 171 of the fixed die 150 and the movable die 170 and opposing surfaces of the fixed duct 110 and the movable duct 130 may enclose the central space around the four sides. Then, air may be supplied to the air supply devices 112 to form or generate the air curtains 114 between the air supply devices 112 and the corresponding air collecting devices 132. As a result, a substantially enclosed region 190 that has six closed sides may be formed between the opposing surfaces 151 and 171 of the mold. Thus, in this representative method, the fixed die 150, the movable die 170, the fixed duct 110, the movable duct 130 and the air curtains 114 may form a closure device for defining the enclosed region 190.

After the enclosed region 190 has been thus formed, the charging blower 120 and the suction blower 122 may be operated to start the charging operation and the drawing operation of the air, respectively. As a result, a flow of air may be produced by the blowers 120 and 122 in the direction from the lower side toward the upper side of the enclosed region 190 as indicated by outline arrows in FIG. 2. The charging blower 120 and the suction blower 122 may constitute a transfer device for transferring the gaseous mold-releasing agent, which will be further explained below.

Then, the spray device 140 may be operated to spray the mold-releasing agents from the sprayer 142 toward the opposing surfaces 151 and 171 of the fixed die 150 and the movable die 170. Therefore, the mold-releasing agents may be applied onto the opposing surfaces 151 and 171, in particular, onto inner surfaces of the spaces 152 and 172, respectively, that are defined in the opposing surfaces 151 and 171. As a result, the cast product at the next molding cycle may be easily removed from the mold with the aid of the mold-releasing agents.

The sprayed mold-releasing agents may be gasified by the latent heat of the fixed die 150 and the movable die 180 after the mold has been cooled and opened to remove cast the product. The gasified mold-releasing agents and the remaining mist of the sprayed mold-releasing agents may then be suctioned by the flow of the air and may be discharged to the outside via the movable duct 130. Because the mold-releasing agents may be sprayed toward the enclosed region 190, scattering of the mold-releasing agents away from the dies 150 and 170 may be minimized. Preferably, the enclosed region 190 may be adjusted to maintain a negative pressure due to the operation balance between the charging blower 120 and the suction blower 122. As a result, the sprayed mold-releasing agents may be reliably prevented from dispersing to the outside through possible clearances created between the dies 150 and 170 and the ducts 110 and 130.

After the operation of the discharge system 100 has been completed to discharge the gaseous or mist-like mold-releasing agent(s), the movable duct 130 may be moved upward away from the fixed duct 110. The mold may then be closed by moving the movable die 170 toward the fixed die 150 such that the movable die 170 contacts the fixed die 150 at the opposing surfaces 151 and 171. The molten material may then be injected into the cavity to mold the next product.

According to the representative embodiment, the mold-releasing agents may be prevented from dispersing to the surrounding environment during the step of applying the mold-releasing agents to the mold of the die-casting machine. In addition, the mold-releasing agents may reliably be discharged to the outside. In particular, the representative embodiment is particularly efficient, because the fixed die 150 and the movable die 170, which are generally provided in known die-casting machines, are used to define two sides of the enclosed region 190.

Further, because the air curtains 114 formed or generated by the air supply devices 112 are utilized to define the remaining two sides of the enclosed region 190, the formation or the cancellation of the enclosed region 190 can be easily and selectively performed by controlling the supply of the air from the air supply devices 112.

Furthermore, because two blowers (i.e., the charging blower 120 and the suction blower 122) may be utilized to produce the stream of air, the mold-releasing agent within the enclosed region 190 may be reliably discharged.

Therefore, the representative embodiment is advantageous, because the dispersion of the mold-releasing agents that may cause deterioration of the working environment may be reliably prevented and because the extra mold-releasing agents may be reliably discharged to the outside.

The present teachings are not limited to the above representative embodiment. Thus, the above representative embodiment may be modified in various ways, such as the examples that are noted below.

(A) Although the air curtains 114 are formed by the streams of air from the air supply devices 112 in order to define a part of the enclosed region 190 in the above representative embodiment, the air curtain 114 may be replaced by another closing means. For example, a shielding plate may be attached to each side of the movable duct 30 such that the shielding plates extend toward the fixed duct 110 in order to define a part of the enclosed region 190.

(B) Although the mold-releasing agents applied to the dies 150 and 170 are adapted to be discharged in the above representative embodiment, the present invention also may be applied to discharge gases, mists or vapors of agents other than mold-releasing agents. For example, if water is sprayed on the dies 150 and 170 in order to cool these dies, water vapor that may be produced during the cooling process may be discharged by using the same discharge system 100.

(C) Although the air flow direction generated by the air supply devices 112 is the same as the air flow direction generated by the blowers 120 and 122 in the representative embodiment, their directions may be opposite to each other.

(D) Further, in order to produce the flow of the air from the lower side toward the upper side of the enclosed region 190, the charging blower 120 is mounted on the lateral side of the fixed duct 110 and the suction blower 122 is mounted on the upper side of the movable duct 130 in the representative embodiment. However, the arrangement of the charging blower 120 and the suction blower 122 may be inverted in order to generate a flow of air from the upper side toward the lower side of the enclosed region 190.

What is claimed is:

1. A discharge system for discharging gases produced in a die-casting machine, which die-cast machine includes a first die and a second die arranged and constructed to form a cast product, comprising:

a closure device arranged and constructed to define a substantially enclosed region between opposing surfaces of the first and second dies; and a transfer device arranged and constructed to discharge gases within the enclosed region to the outside, wherein the first and second dies define a portion of the closure device when the first and second dies are opened.

2. A discharge system as in claim 1, wherein the closure device includes an air supply device that cooperates with the first and second dies, the air supply device producing a stream of air that defines at least the other part of the enclosed region.

3. A discharge system as in claim 1, wherein the transfer device includes at least one of a charging blower and a suction blower, the charging blower being arranged and constructed to charge the air into the enclosed region, and the suction blower being arranged and constructed to suction gases from the enclosed region.

4. A discharge system as in any of claims 1, wherein the discharge system is designed to discharge mold-releasing agents that have been vaporized by being sprayed onto the first and second dies.

5. A discharge system as in claim 1, wherein the closure device includes a pair of opposing first and second shields, and the transfer device includes a pair of opposing first and second ducts, and the closed space has six sides including a first set of opposing sides defined by the first and second dies, a second set of opposing sides defined by the first and second shields, and a third set of opposing sides defined by the first and second ducts, wherein the first and second ducts are arranged and constructed to provide an air flow path passing through the enclosed region.

6. A discharge system as in claim 5, wherein the first and second shields comprise air curtains that are created by air streams produced by air supplied from first and second air supply devices respectively disposed on the first duct.

7. A discharge system as in claim 6, further including first and second air collecting devices disposed on the second duct and being arranged and constructed to respectively collect the air supplied from the first and second air supply devices.

8. A discharge system as in claim 5, wherein the first and second dies are movable toward and away from each other, and the first and second ducts also are movable toward and away from each other.

9. A discharge system for discharging gases produced in a die-casting machine, which die-cast machine includes a first die and a second die arranged and constructed to form a cast product, comprising:

means for defining a substantially enclosed region between opposing surfaces of the fist and second dies when the fist and second dies are opened; and means for discharging gases within the enclosed region to the outside.

10. A method for discharging gases produced by a die-casting machine, which die-cast machine includes a first die and a second die arranged and constructed to form cast products, comprising:

discharging gases within a substantially enclosed region to the outside, the enclosed region being defined between opposing surfaces of the first and second dies when the first and second dies are opened.

11. A method as in claim 10, further including generating flow of air in order to define a portion of the enclosed region in addition to portions defined by the first and second dies.

12. A method as in claim 10, further including transferring gases within the enclosed region by at least one of charging air into the enclosed region and/or suctioning the gases out of the enclosed region.

13. A method as in claim 10, wherein the gases comprise gasified mold-releasing agents that have been sprayed onto the first and second dies.

* * * * *